US005444521A

United States Patent [19]

Tomoyuki et al.

[11] Patent Number: 5,444,521

[45] Date of Patent: Aug. 22, 1995

[54] IMAGE FIXING DEVICE CAPABLE OF CONTROLLING HEATING OVERSHOOT

[75] Inventors: Yohji Tomoyuki, Ichikawa; Shunji Nakamura, Yokohama; Yasumasa Ohtsuka, Yokohama; Kouichi Okuda, Yokohama; Eihiro Sakaki, Chofu; Akira Hayakawa, Machida; Daizo Fukuzawa, Tokyo, all of Japan

[73] Assignee: Canon Kabushiki Kaisha, Tokyo, Japan

[21] Appl. No.: 912,722

[22] Filed: Jul. 13, 1992

[30] Foreign Application Priority Data

Jul. 15, 1991 [JP] Japan ..... 3-173952
Oct. 31, 1991 [JP] Japan ..... 3-286440

[51] Int. Cl.[6] ..... G03G 15/20
[52] U.S. Cl. ..... 355/285; 355/208
[58] Field of Search ..... 355/282, 285, 289, 286, 355/287, 288, 291, 208; 214/290, 216

[56] References Cited

U.S. PATENT DOCUMENTS 4,144,835 3/1979 Fukase et al. ..... 219/216 X
4,415,800 11/1983 Dodge et al. ..... 219/216 X
4,551,007 11/1985 Elter ..... 219/216 X
4,719,489 1/1988 Ohkubo et al. ..... 219/216 X
4,821,069 4/1989 Kusumoto ..... 219/216 X
4,868,368 9/1989 Araki ..... 219/216
4,914,476 4/1990 Nishitsuji et al. ..... 355/208
5,114,337 5/1992 Yamazaki ..... 219/216 X
5,179,263 1/1993 Koh et al. ..... 219/216
5,241,155 8/1993 Koh et al. ..... 219/216

FOREIGN PATENT DOCUMENTS 390168 10/1990 European Pat. Off. .
63-313182 12/1988 Japan .
2-62575 3/1990 Japan .
02157878 6/1990 Japan .
2-309382 12/1990 Japan .
3-12685 1/1991 Japan .

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image heating device which includes a heater; a temperature detecting element to detect a temperature of the heater; and a controller for controlling power supply to the heater, so that the temperature detected by the temperature detecting member is maintained at a predetermined temperature, and the controller controls the power supply to the heater, based on a rising speed of the temperature detected during a period from the time when the power supply to the heater is started till the time when the temperature reaches the predetermined temperature.

11 Claims, 22 Drawing Sheets

| | |
|---|---|
| P8 | k+4 |
| P7 | k+3 |
| P6 | k+2 |
| P5 | k+1 |
| P4 | k o |
| P3 | k-1 |
| P2 | k-2 |
| P1 | k-3 |
| P0 | k-4 |

FIG. 19

| TEMP GRADIENT | + TEMP DIFF − | | | | | | |
|---|---|---|---|---|---|---|---|
| | (3) | | | | (4) | | |
| | a | b | c | d | e | f | g |
| | ΔT-3 | ΔT-2 | ΔT-1 | ΔT 0 | ΔT+1 | ΔT+2 | ΔT+3 |
| k+2 | | P4 | P3 | P2 | P1 | P0 | |
| k+1 | | P5 | P4 | P3 | P2 | P1 | |
| k o | P8 | P6 | P5 | P4 | P3 | P2 | P0 |
| k-1 | | P7 | P6 | P5 | P4 | P3 | |
| k-2 | | P8 | P7 | P6 | P5 | P4 | |

FIG. 20

| TEMP GRADIENT | + TEMP DIFF − | | | | | | |
|---|---|---|---|---|---|---|---|
| | (3) | | | | (4) | | |
| | a | b | c | d | e | f | g |
| | ΔT-3 | ΔT-2 | ΔT-1 | ΔT 0 | ΔT+1 | ΔT+2 | ΔT+3 |
| k+2 | P8 | P3 | P1 | P0 | P0 | P0 | P0 |
| k+1 | | P4 | P2 | P1 | | | |
| k 0 | | P5 | P3 | P2 | P1 | | |
| k-1 | | P6 | P4 | P3 | P2 | | |
| k-2 | | P7 | P5 | P4 | P3 | | |

| | |
|---|---|
| P8 | k+6 |
| P7 | k+5 |
| P6 | k+4 |
| P5 | k+3 |
| P4 | k+2 |
| P3 | k+1 |
| P2 | ko |
| P1 | k-1 |
| Po | k-2 |

IMAGE FIXING DEVICE CAPABLE OF CONTROLLING HEATING OVERSHOOT

FIELD OF THE INVENTION AND RELATED ART

The present invention relates to an image heating device which is usable in an image forming apparatus such as a copying machine or electrostatic recording apparatus in order to improve the surface properties of the image or fix the image on recording material by heating.

As a thermal fixer, that is, a typical image heating device, those employing a fast responding heater and an endless loop of thin film had been proposed in Japanese Laid-Open Patent Nos. 313182/1988 and 157878/1990.

An example of such a heating apparatus employing thin film is shown in FIG. 11.

This example is a heating apparatus comprising a thin heat resistant film (or sheet) 1; a driving means for moving this film 1; a heater 6 which is fixedly supported in a manner so as to contact one of the surfaces of this film 1 from inside the film loop; and a pressing member 2 which is positioned across this film 1 to press a back surface of recording material P, to press the side of the recording material to the heater 6 with this film 1 therebetween; wherein basically, at least whole the image fixing process is carried out, this film 1 is driven to move at approximately the same speed and in the same direction as those of the recording material P which is fed into the nip section, that is the fixing section, formed by pressing the heater 6 and the pressing member 2 to each other with this moving film 1 therebetween, so that that surface of this recording material, on which the unfixed image is carried, is heated through this film 1 by this heater 6 to apply heat energy to soften and fuse the unfixed image, and sequentially, the film 1 and the recording material P are separated at a separating point past the fixing section.

Reference numeral 12 designates a tension roller for providing tension to the film 1.

This type of heating method employing thin film as the above enables the use of a heater having an extremely small thermal capacity and fast thermal response. Therefore, the length of time it will take for the heater to reach a predetermined heating temperature can be significantly shortened.

As for the temperature control of the heater 6, the power supplied to the heating element 5 is regulated, so that the temperature of the heater 6 detected by a thermistor 4 remains constant at a predetermined temperature.

However, if there are fluctuations in input voltage, or a large variance in resistance value, the amount of heat output from the heater varies, deteriorating the accuracy of the thermostatic control.

Therefore, it is conceivable to detect the input voltage or the resistance value of the heater, and then, use the results of this detection to adjust the power supply, but such an arrangement requires special detection circuits, and it also takes otherwise unnecessary time for detection.

Also, as a method for fixing unfixed images, a heat roller type is widely used.

Basically, a heating roller, which is controlled to maintain a predetermined temperature, and a pressing roller, which is pressed thereon, are made to form a pair, and the recording material carrying the unfixed image is passed between the pair so as for the image to be fixed.

An example of the temperature control circuit for the heating roller is shown in FIG. 12.

Reference numeral 25 designates a halogen heater provided within the heating roller, and 29 designates the thermistor provided on the surface of the heating roller.

Reference numeral 26 is a comparator which compares voltages $V_T(=R_T/(R_1+R_2)\times Vcc)$ with control target voltage Vret and outputs an ON-signal if the voltage $V_T$ has not reached the target voltage Vret and an OFF-signal if the voltage $V_T$ has reached Vret. Reference numeral 24 refers to a heater driving circuit to supply an alternating voltage S5 to the halogen heater 5.

FIG. 13 is an operational flow chart for the temperature control circuit shown in FIG. 12.

The comparator 26 compares the inputted voltage $V_T$ and Vret (100), and if the voltage $V_T$ has not reached the voltage Vret (101), it turns on the halogen heater 25 (103), and when the voltage $V_T$ has reached the voltage Vret (101), it turns off the halogen heater 25 (102).

The temperature fluctuation of the heating roller is shown in FIG. 14.

$\Delta T_1$ is the amount of overshoot corresponding to a target temperature Tret and $\Delta T_2$ is the amount of undershoot. Q1 is the length of time it takes to reach the target temperature Tret from the commencement of the temperature control, and Q2 is the temperature control period thereafter.

It is evident from this figure that the power is in oversupply in the period Q1, generating a large amount of overshoot $\Delta T_1$. On the other hand, a fairly large amount of understood $\Delta T_2$ occurs in the period Q2.

Since the amounts of the temperature deviations $\Delta T_1$ or $\Delta T_2$ from the corresponding thermostatic target temperatures are large, uniform temperature distribution could not be accomplished in the direction of recording material conveyance, which tends to cause deterioration of the quality due to the degradation of fixing uniformity.

SUMMARY OF THE INVENTION

The primary object of the present invention is to provide an image heating device in which the heating element is prevented from overshooting.

Another object of the present invention is to provide an image heating device capable of executing accurate thermostatic control even if the amount of heat emission from an exothermic resistor fluctuates.

Another object of the present invention is to provide an image heating device which does not cause the degradation of fixing uniformity in the direction of recording material conveyance.

A further object of the present invention is to provide an image heating device comprising a heater, a temperature detecting member to detect the temperature of said heater, a control means for controlling the power supplied to said heater so that the temperature detected by said temperature detecting member is maintained constant at a predetermined temperature; wherein said control means controls the power supplied to said heater, based on the rising speed of the temperature detected during the period from the time when the power begins to be supplied to the heater till the time when the temperature reaches said predetermined one.

A yet further object of the present invention is to provide an image heating device comprising a heater controlled to maintain a predetermined temperature, a temperature detecting member to detect the temperature of said heater, and a current control means for controlling the power supplied to the heater, based on the temperature gradient of said heater and the temperature deviation from said predetermined temperature.

According to an aspect of the present invention, there is provided an image heating device comprising a heater of which temperature is maintained at a predetermined one; a temperature detecting member to detect the temperature of said heater, an arithmetic means for computing, based on the temperature gradient, the length of time it takes for the temperature of said heater to reach said predetermined one from the time when the power begins to be supplied to said heater, and a power control means for halting temporarily the current supplied to said heater, and then, controlling the power supplied to said heater after an elapse of the length of time computed by said arithmetic means, so that the temperature of said heater is maintained constant at a predetermined one.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 19 is a tabulated version of the relation in FIG. 18.

FIG. 20 is a control table to be used for the fifth embodiment of the present invention.

DESCRIPTION OF THE PREFERRED EMBODIMENTS

The preferred embodiments of the present invention will be described.

Figure 1:
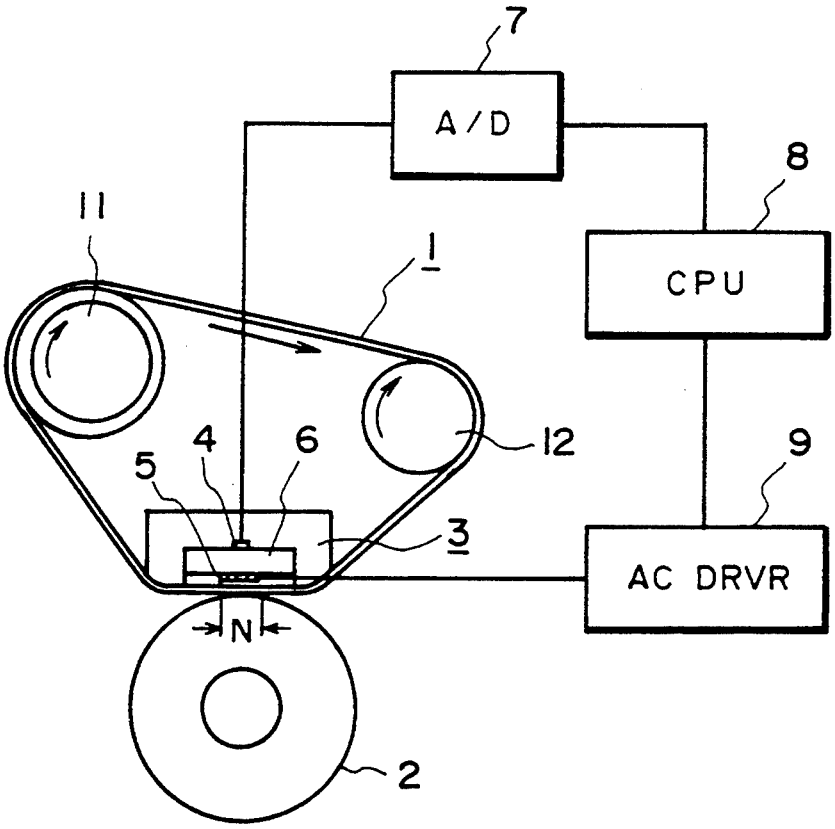
FIG. 1 is a sectional view of the image heating device in accordance with an preferred embodiment of the present invention.

FIG. 1 presents a sectional view of the thin film type heating device in accordance with the embodiment of the present invention, as well as a block diagram of control section to control the surface temperature of the heater.

In this preferred embodiment, the present invention is applied to a thermal fixing device of a laser beam printer (not illustrated) which outputs eight A4 size sheets per minute at a speed (process speed) of 50 mm/sec.

Figure 11:
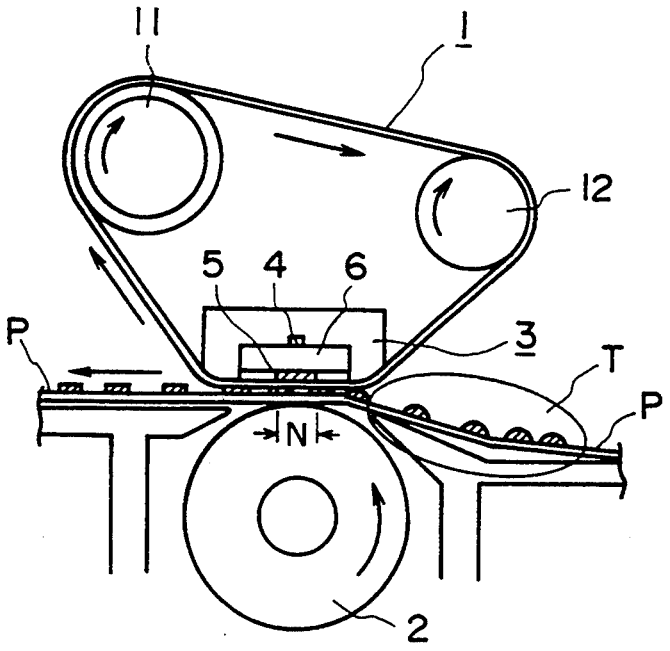
FIG. 11 is a sectional view of the prior fixing device.

The basic structure of this thermal fixing device is the same as that in FIG. 11, and the detailed description is spared.

The heater 6 extends in the direction approximately perpendicular to the moving direction of the film, and comprises a piece of 1 mm thick ceramic material having a high heat conductivity, and an exothermic resistor with a resistance value of 34 Ω, provided on the bottom surface of this ceramic piece.

On the upper surface of the ceramic piece, the thermistor 4, which is the temperature detecting element, is provided.

The output signal of the thermistor 4 is inputted through an A/D converter 7 to a CPU 8. The CPU 8 controls, through an AC driver 9, the power supplied to the heating element 5, based on this input signal, so that the surface temperature of the heater is maintained at 180° C. The amount of power supplied is determined in the following manner. During the first transition period, the full power is supplied at a duty factor of 100% to measure the speed, in other words, the rate at which the temperature detected by the thermistor 4 rises from 160° C. to 170° C., before it reaches 180° C. Based on the measurement, the power supply ratio (a %) to W is determined to optimize the power supply (Wo) for sustaining the temperature of 180° C.

Figure 2:
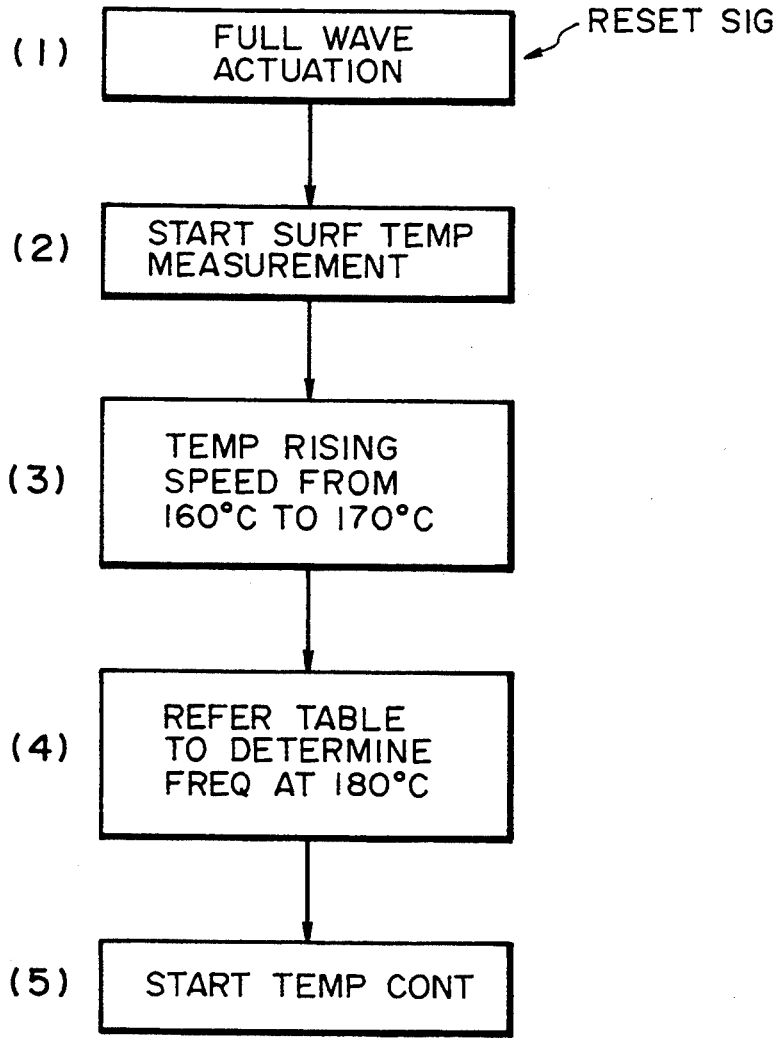
FIG. 2 is a flow chart for the preferred embodiment of the present invention.

In FIG. 2, the flow chart of the temperature control method in accordance with the preferred embodiment of the present invention is shown.

(1) As the power supply (full pulse) is started for the image forming apparatus provided with the film type heat fixing device in accordance with the preferred embodiment of the present invention, a reset signal is inputted to the CPU 8, and (2) the measurement of the surface temperature of the heater 6 begins. Next, (3) the length of time it takes for the heater surface temperature to rise from 160° C. to 170° C. is detected, and the power supply ratio wave number is determined, based on the table showing the rising speed of temperature and the optimum power supply for sustaining the temperature of 180° C. (5) The thermostatic: control begins.

Now then, the table used for determining the power supply ratio or the wave number is explained in detail.

Figure 3:
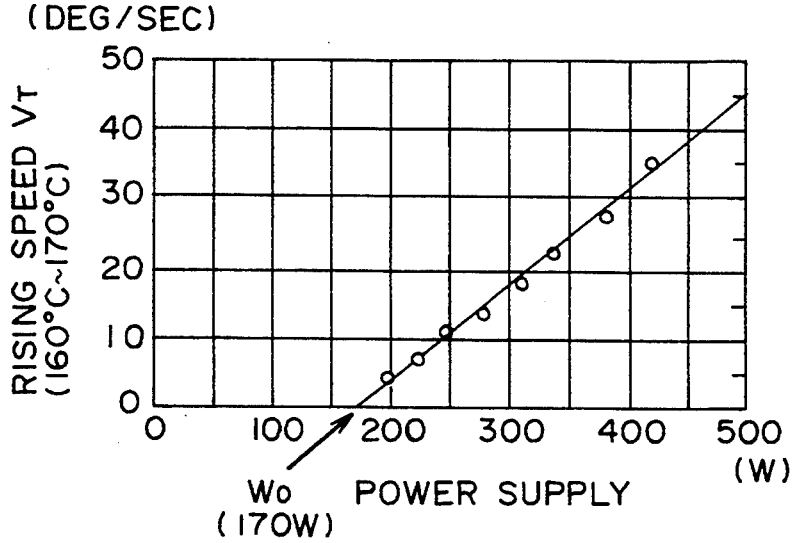
FIG. 3 is a graph showing the relation between the rising speed of temperature and the power supplied.

As is shown in FIG. 3, the power supplied to the heater 6 and the rising speed of the heater surface correspond to each other in a one-to-one relation if the temperature is in the vicinity of 180° C. Therefore, the power can be determined by measuring the rising speed of the heater temperature.

Also, the power to be supplied (Wo) to sustain the temperature of 180° C. can be determined from this table. This means that the rising speed of temperature is zero, and in this preferred embodiment, the power (Wo) is 170 W. In other words, the temperature of the heater is sustained at 180° C. by continuously supplying 170 W. The ratio (a %) at which the input power (W) is converted to the optimum power (Wo) is expressed as follows:

$$a\ (\%) = Wo/W \times 100$$

Figure 4:
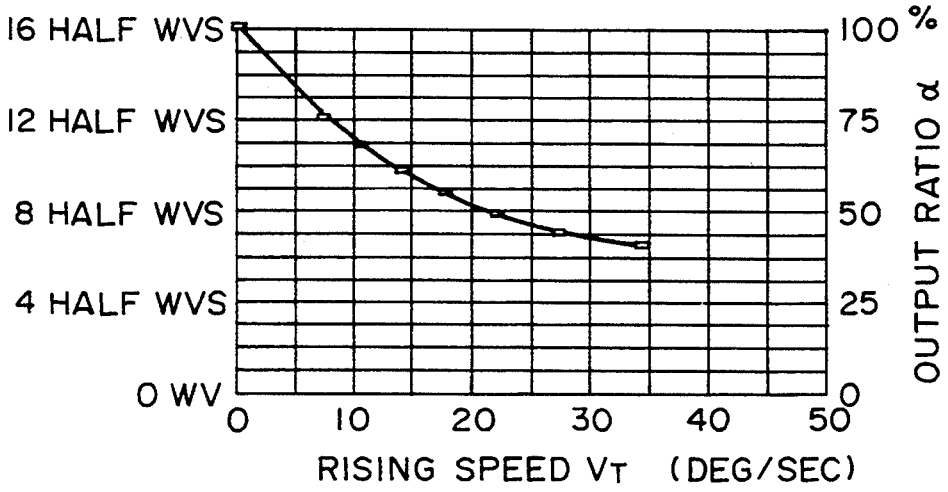
FIG. 4 is a graph showing the relation between the rising speed of temperature and the optimum power supplied.

Since the relation between the rising speed of temperature and the input power is known from FIG. 3, the relation between the rising speed of temperature and the power supply ratio a (%) can be determined as is shown in FIG. 4. This becomes the reference table for the power correction based on the detection of the rising speed of temperature. Since a wave number control which counts 16 half waves as one cycle is adopted in this embodiment, the wave number to be supplied in response to the rising speed of temperature can be plotted as is shown in FIG. 4.

Figure 5:
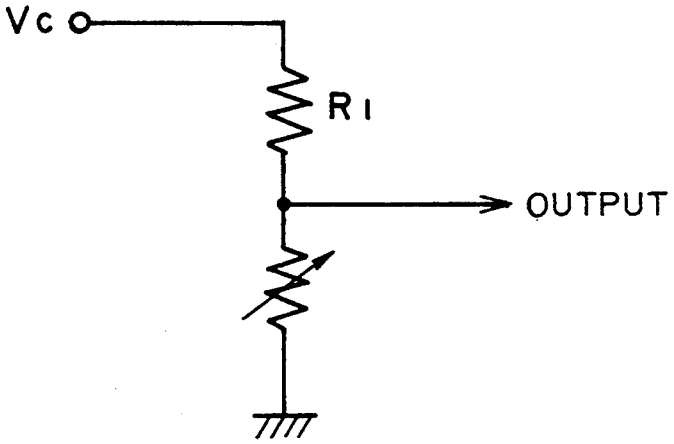
FIG. 5 is a schematic diagram showing the temperature detection circuit.

It is preferable for the surface temperature detection of the heater 6 to be in the vicinity of 180° C. when the rising speed of temperature is detected. This is because the resistance value of the thermistor 4 changes exponentially instead of linearly, and the correct sensing is not possible over a wide temperature range. Therefore, it is preferable that the value of $R_1$ in the control circuit shown in FIG. 5 is so selected that the sensor output is correct in the temperature close to the actual target temperature. More particularly, it is preferable for the rising speed of the temperature to be detected in a temperature range higher than 100° C. Also, since the amount of overshoot if the rising speed is detected in the vicinity of 180° C., the length of time it takes for the heater surface temperature to rise from 160° C. to 170° C. is measured to determine the rising speed of the temperature in this embodiment.

If an algorithm such as the above is adopted, the optimum power to be supplied during the period in which the temperature of the heater 6 is to be sustained at a predetermined temperature can be determined just by detecting the rising speed of the surface temperature of the heater 6.

Second Embodiment

Figure 6:
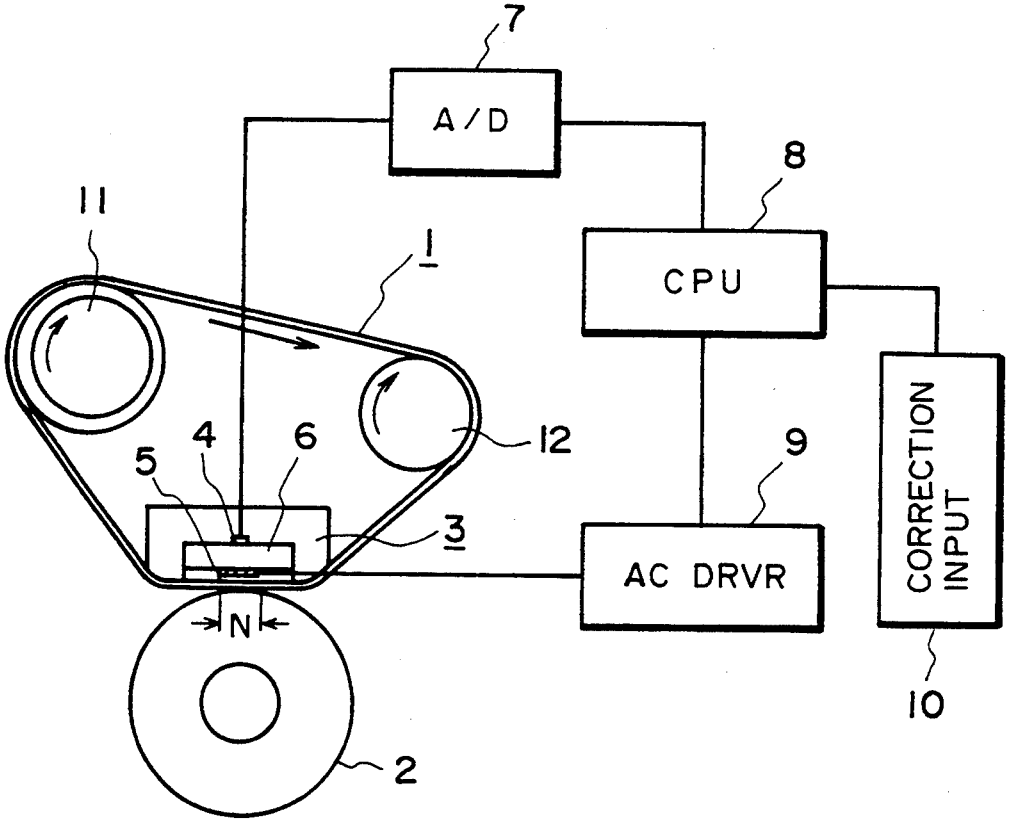
FIG. 6 is a sectional view of the second embodiment of the present invention.

FIG. 6 presents a simplified sectional view of the film type heat fixing device in accordance with the second embodiment of the present invention, along with a block diagram of the control section. In this embodiment, a correction value input section 10 is provided to correct the temperature measurement variance of the thermistor 4. As to the method for obtaining this correction value input, in order to obtain the temperature measurement error of the thermistor 4, the output value of the thermistor 4 which has been measured in advance is compared to the output value of a reference or typical thermistor, or the transitional surface temperature curve of the heater 6 positioned in the film type fixing device is obtained, and the output voltage of the thermistor 4 corresponding to this curve is compared to the output voltage of the same typical thermistor so as to determine the deviation in the outputs. The correction information is inputted to the CPU 8, using, for example, a DIP switch or the like, after the temperature measurement error of the thermistor 4 is obtained in the above mentioned manner. The CPU 8 makes a general adjustment of the wave number values in the table which shows the relation between the rising speed of temperature and the wave number, based on this correction information, whereby a more stable thermostatic control becomes possible irrespective of the difference of individual devices.

Third Embodiment

Figure 7:
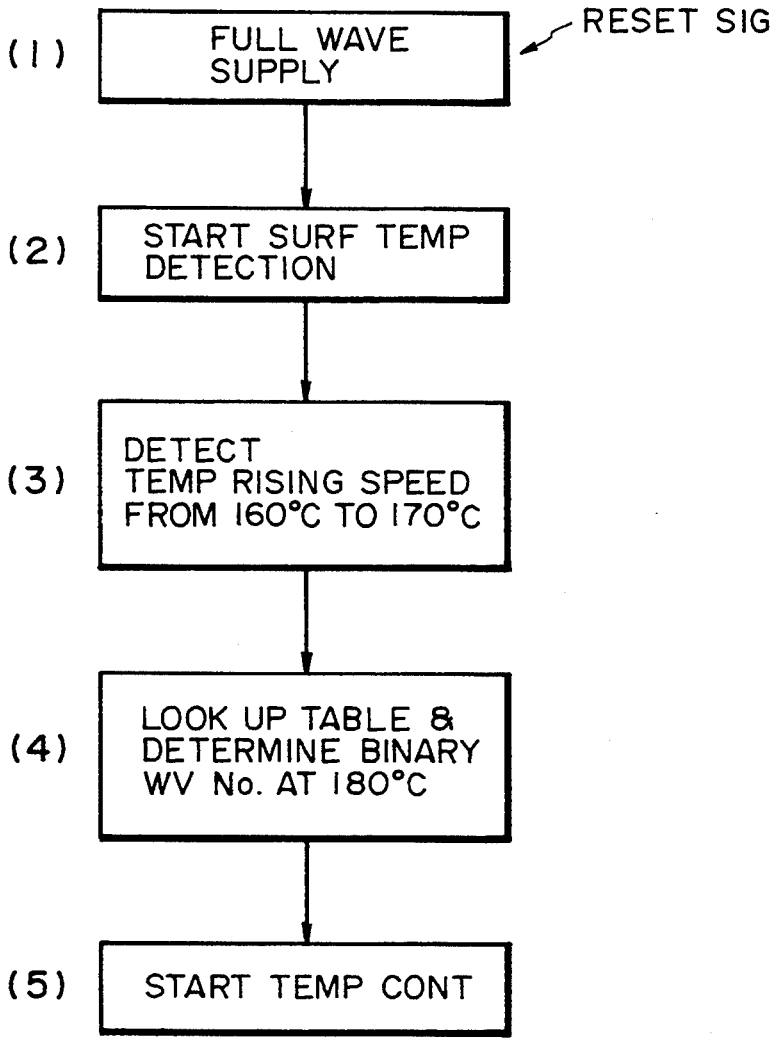
FIG. 7 is a flow chart for the third embodiment of the present invention.

Referring to FIG. 7, a further preferred embodiment of the present invention is described.

In the first and second embodiments, a predetermined amount of power is continuously supplied to the heating element during the period when the heater temperature is sustained at a predetermined temperature. However, if these is wide variance in the thermistor performance or the like, or these are environmental changes, the heater temperature sometimes devices from the predetermined fixing temperature.

Therefore, in this embodiment, the heater temperature is sustained at the predetermined temperature by means of repeatedly carrying out the process of increasing or decreasing the heater temperature.

In other words, the heater temperature is detected even during constant temperature operation, and if the detection output of the thermistor is lower than the predetermined value which is set corresponding to the predetermined fixing temperature, the adjusted power for increasing the heater temperature is applied, and if it is higher than the predetermined value, the adjusted power for decreasing the heater temperature is applied.

In FIG. 7, since steps (1) to (3) of the flow chart in FIG. 7 are similar to those for the first embodiment, their description are omitted for simplicity.

Figure 8:
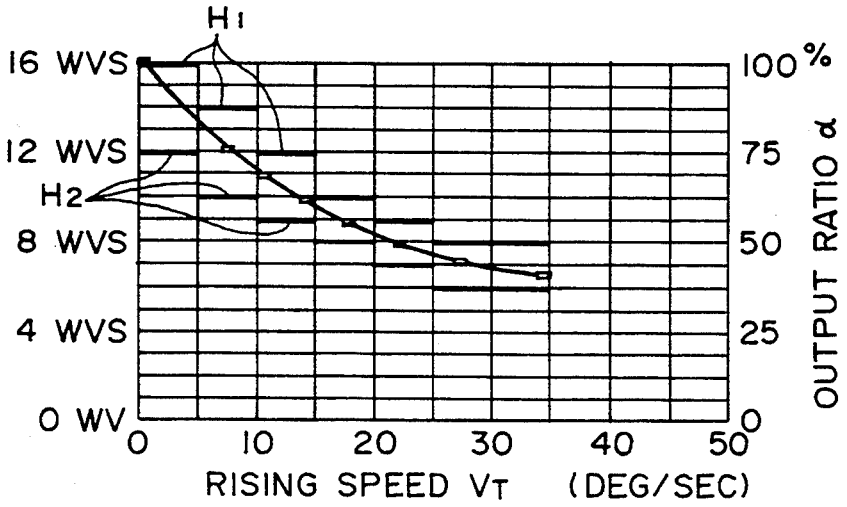
FIG. 8 is a graph showing the relation between the rising speed of temperature and the optimum number of output waves regarding the third embodiment of the present invention.

In step (4), two wave numbers are determined based on the rising speed of temperature from 160° C. to 170° C.: a wave number $H_1$ for supplying the larger power than the theoretical wave number (solid line in the FIG. 8) for supplying the power to sustain 180° C., and a wave number $H_2$ which supplies the smaller power than the theoretical wave number.

In step (5), if the temperature detected by the thermistor is higher than 180° C., the current is applied using the wave number $H_2$ to decrease the heater temperature, and if it is lower than 180° C., the current is applied using wave number $H_1$ to increase the heater temperature.

It should be noted that in this embodiment, the power is supplied even while the heater temperature is to be lowered, and this is due to the fact that if the current is turned off, the temperature rapidly drops because of the small heat capacity of the heater, with the result of larger magnitude of thermostatic ripple.

Thus, according to this embodiment, the heater temperature can be maintained at the predetermined temperature with smaller ripples.

Fourth Embodiment

The necessary energy to maintain the constant temperature is not identical between the case in which a device is cold and the case in which the same device has been sufficiently warmed up.

That is, if the device is cold, a large portion of the heat is robbed by the pressing roller, for example, and therefore, the thermostatic condition cannot be maintained unless proportionally more energy is supplied to the heater.

On the contrary, the amount of heat robbed from the heater becomes smaller after continuous sheet passages, making smaller the necessary energy for maintaining a constant temperature, since the device has been warmed up.

Figure 10:
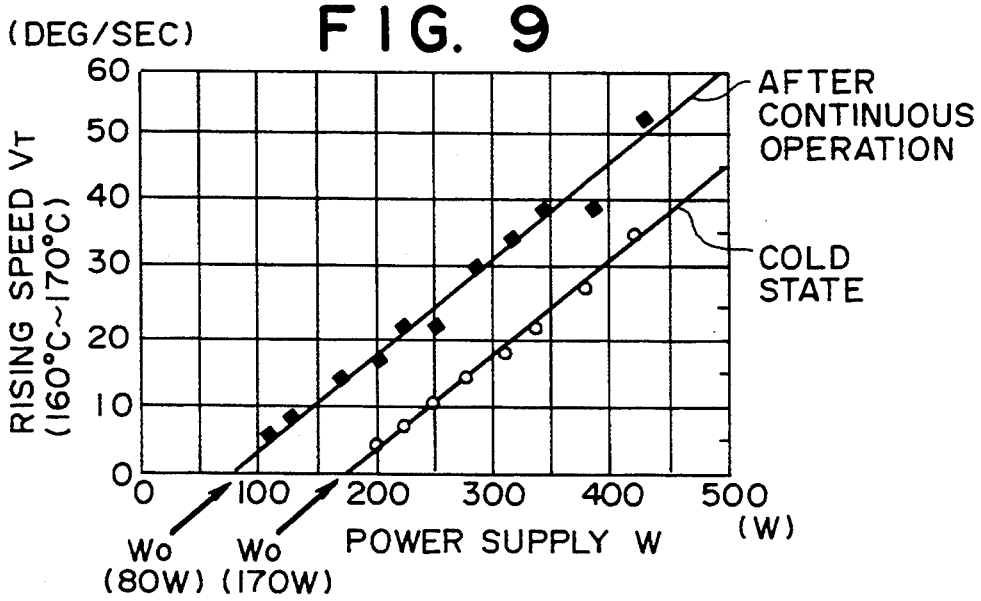
FIG. 10 is a graph showing the relation between the rising speed of the heater temperature and the optimum power supplied regarding the fourth embodiment.

The above observation is summarized in FIG. 10. As is evident from FIG. 10, the optimum necessary input power is 80 W after continuous sheet passages. At this time, the relations between the power and the rising speed of temperature translate to the left, proportional to the decreased amount of the optimum power.

Figure 9:
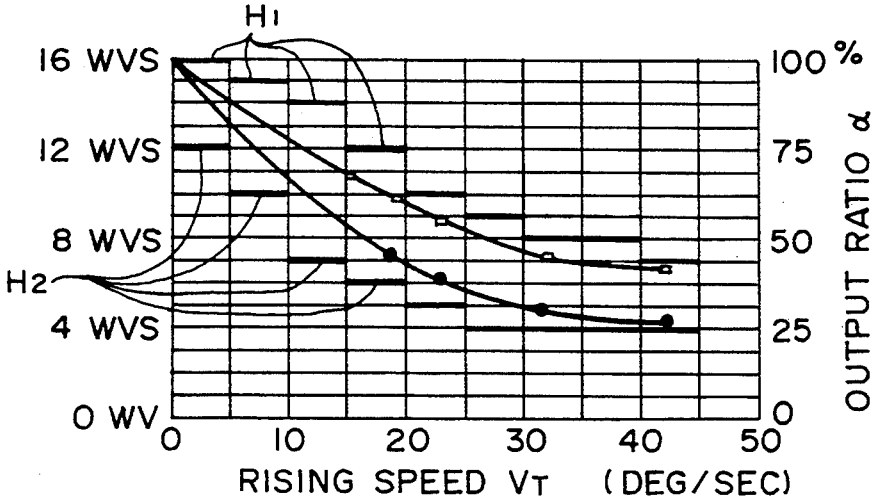
FIG. 9 is a graph showing the relation between the rising speed of temperature and the optimum number of output waves regarding the fourth embodiment of the present invention.

In order to satisfy these two systems, two values, $H_I$ and $H_2$ are determined using the table in FIG. 9, in such a manner that the wave number $H_1$ is a wave number to supply slightly more power than the optimum power when the device is cold, which is 170 W, and $H_2$ is a wave number to supply slightly less power than the optimum necessary power after the continuous sheet passages, which is 80 W.

By the above arrangement, thermostatic control for maintaining 180° C. becomes possible, whether the device is cold or warm.

In the first to fourth embodiments, the number of waves is controlled to regulate the power supply, but phase control may be adopted. Also, pulse width may be changed in the case of a pulse current.

Moreover, this arrangement can also be applied to a heating roller or the like if their heat capacities as a heater are small.

Fifth Embodiment

Another embodiment of the present invention will be described.

Figure 15:
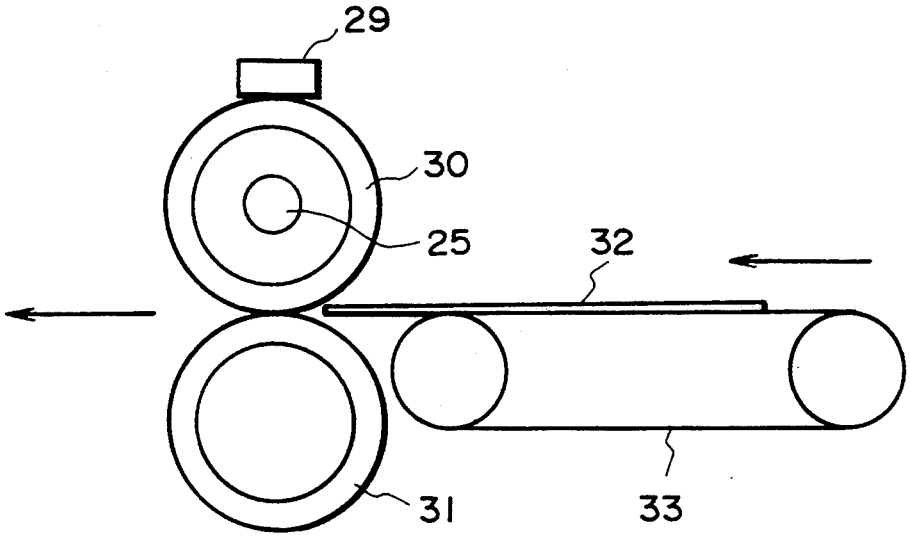
FIG. 15 is a simplified sectional view of a heat-roller fixing device that is the heating device in accordance with the preferred embodiment of the present invention.

FIG. 15 is a sectional view of an image heating device in accordance with an embodiment of the present invention, which is used for thermal fixing.

A recording sheet 32 carrying an unfixed toner particle image is delivered in the arrow direction, and is conveyed by the conveyer belt 33 to be fed into the nip section formed between the heating roller 30 and the pressing roller 31.

Reference numeral 25 depicts a halogen heater, which receives power to generate heat. The power supplied to this heater is controlled so that the resistance value of the thermistor 29, which is a temperature detecting element provided in contact with the surface of the heating roller, remains constant.

Figure 16:
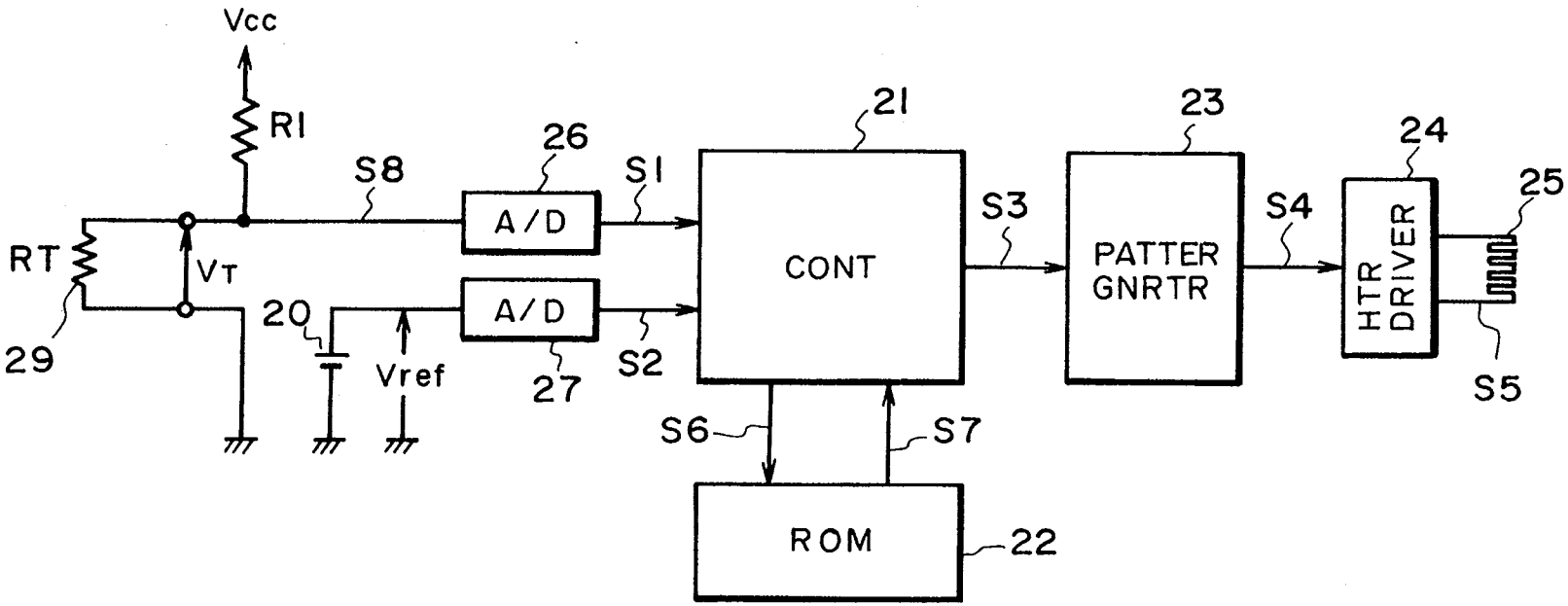
FIG. 16 is a schematic diagram of the temperature control circuit of the heating device in accordance with the fifth embodiment of the present invention.

FIG. 16 is a schematic diagram of the heating device in accordance with the embodiment of the present invention.

Figure 12:
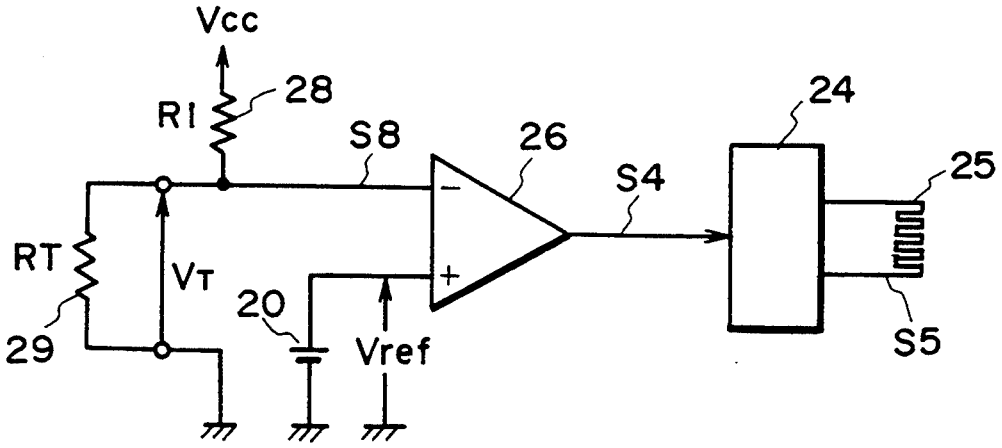
FIG. 12 is a schematic diagram showing an example of the temperature control circuit.
Figure 13:
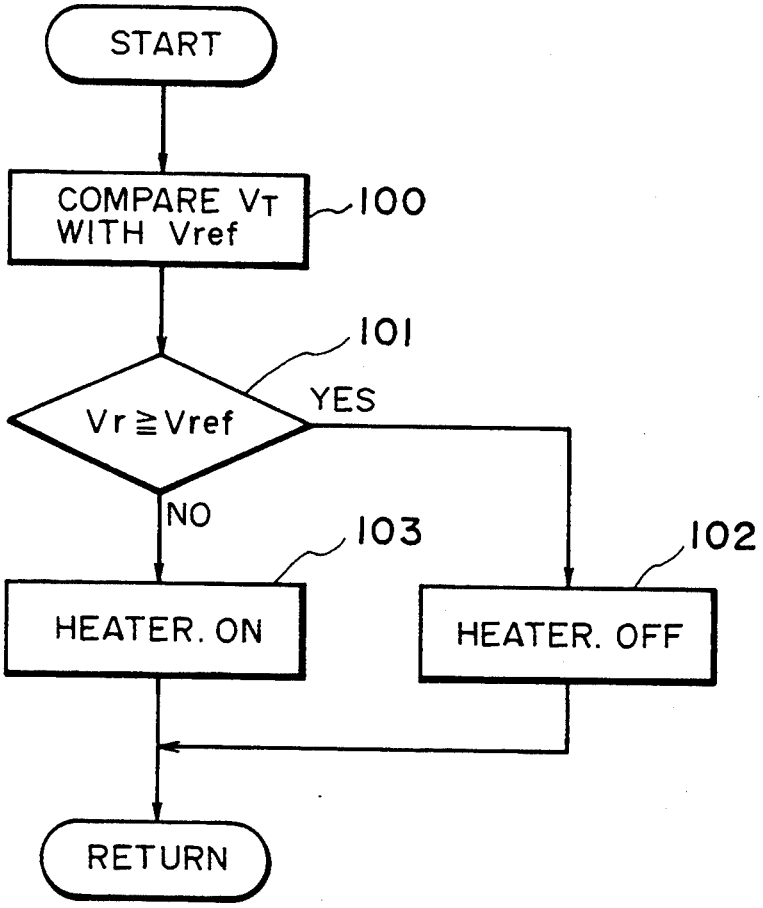
FIG. 13 is a flow chart describing the operation of the temperature control circuit in FIG. 12.
Figure 14:
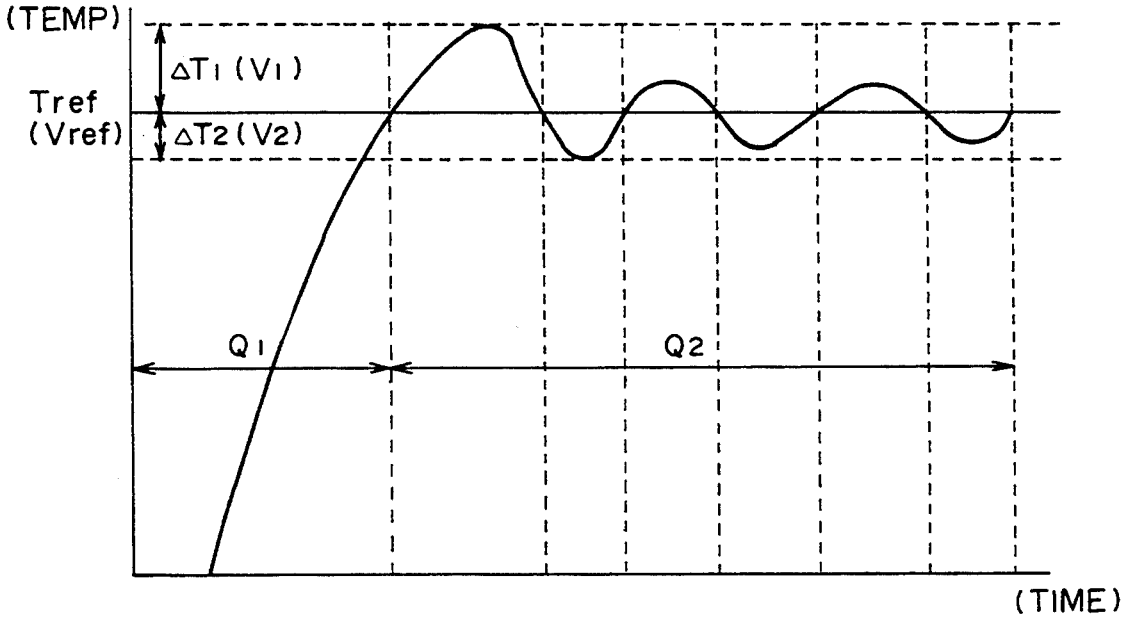
FIG. 14 is a graph showing the temperature fluctuation affected by the temperature control circuit in FIG. 12.

The same reference numerals as in FIG. 12 are assigned to the elements having the same functions.

Reference numeral 26 designates an A/D converter which is used to obtain a digital value S1 based on a voltage $V_T$ obtained as a divided voltage ratio by a thermistor 25 and a resistor $R_1$. Reference numeral 27 designates an A/D converter which is used to obtain a digital value S2 based on the control target voltage Vret. The A/D converter 26 and the A/D converter 27 outputs for every predetermined period, the respective digital values S1 and S2 to the control section 21, will be described later.

Reference numeral 21 refers to the control section to transfer the computation data and select a control table stored in the ROM 22 functioning as a storing means.

In the ROM 22, which is a storing means, a control table for the relation between the temperature gradient and the power supply pattern is stored.

Reference numeral 23 refers to a power supply pattern generator, which outputs a heater control signal S4 to a heater driving circuit 24, based on the power supply pattern selection signal S3 from the control section 21.

The controls of this control procedure will be described later in detail.

The heater driving circuit 24 drives the halogen heater 25, by AC current, based on the heater control signal S4.

Figure 17:
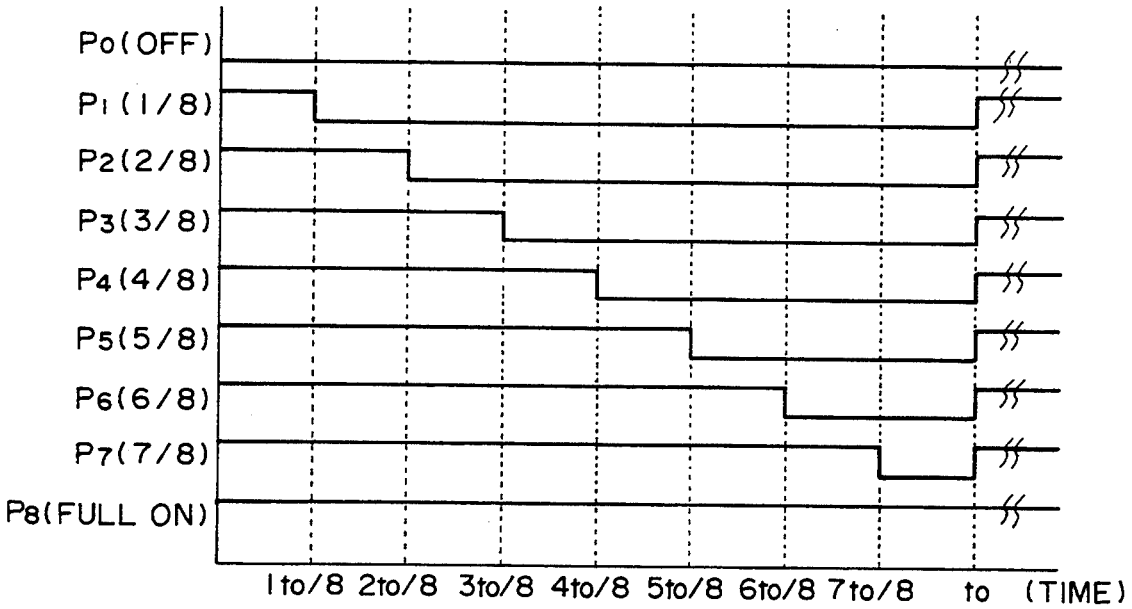
FIG. 17 is a diagram showing the power supply pattern of the fifth embodiment of the present invention.

FIG. 17 shows the heater control signal S4 outputted by the pattern generator 23. The heater control signal S4 is outputted to the heater driving circuit 24, for every predetermined interval $T_0$, in various pulse widths, based on the pattern selection signal S3 from the arithmetic processing unit 21. In this embodiment, the predetermined interval $T_0$ is equally divided into eight sections, but it is not necessary to adhere to this particular value. Letting the power supplied to the fixing device during the full power operation be Wo, the powers corresponding to power supply patterns $P_0$ to $P_8$ become 0, Wo/8, 2Wo/8, . . . Wo.

Figure 18:
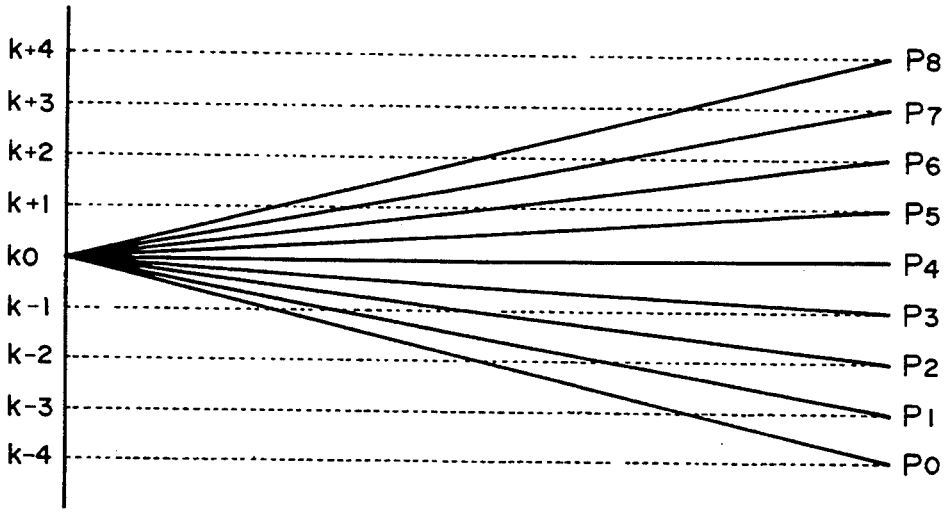
FIG. 18 is a diagram showing the relation between the power supply pattern and the temperature gradient.

FIG. 18 shows an example of the temperature gradient in the vicinity of the target temperature, which is obtained when the power supply pattern in FIG. 17 is outputted to the heater driving circuit 24. Letting the temperature gradient be $k_i$, $k_i$ becomes proportional to the power supply pattern, displaying a pattern as is shown in this figure. This figure remains approximately the same for the heating device of a similar product.

The temperature gradient $k_{+4}$ is the temperature gradient when the power is supplied to the halogen heater using the power supply pattern $P_8$, which is the full supply pattern, and $k_{+3}$ corresponds to $P_7$, $k_{+2}$ to $P_6$, $k_{+1}$ to $P_5$, $k_0$ to $P_4$, $k_{-1}$ to $P_3$, $k_{-2}$ to $P_2$, $k_{-3}$ to $P_1$, and $k_{-4}$ corresponds to $P_0$ which is the no power supply pattern.

The temperature increases in the cases of the power supply patterns $P_7$ to $P_5$, and in the case of $P_4$, the temperature variation becomes approximately zero.

In the case of the power supply patterns $P_3$ to $P_1$, the temperature declines.

FIG. 19 is a tabulated version of FIG. 18. The following control table is produced based on this one.

FIG. 20 is a control table stored in the storing means 22. In FIG. 20, the region $\Delta T_{-3}$, $\Delta T_{-2}$ and $\Delta T_{-1}$ in the row direction are the regions where the deviations of the measured temperature from the target temperature are negative; $\Delta T_0$ is the region where the temperature deviation is near zero; and $\Delta T_{+1}$, $\Delta T_{+2}$, and $\Delta T_{+3}$ are the regions where the temperature deviation is positive. Also, $k_{+2}$ and $k_{+1}$ in the column direction are the regions where the temperature gradient is positive; $k_0$ is the region where the temperature gradient is approximately zero; and $k_{-1}$ and $k_{-2}$ are the regions where the temperature gradient is negative.

Figure 21:
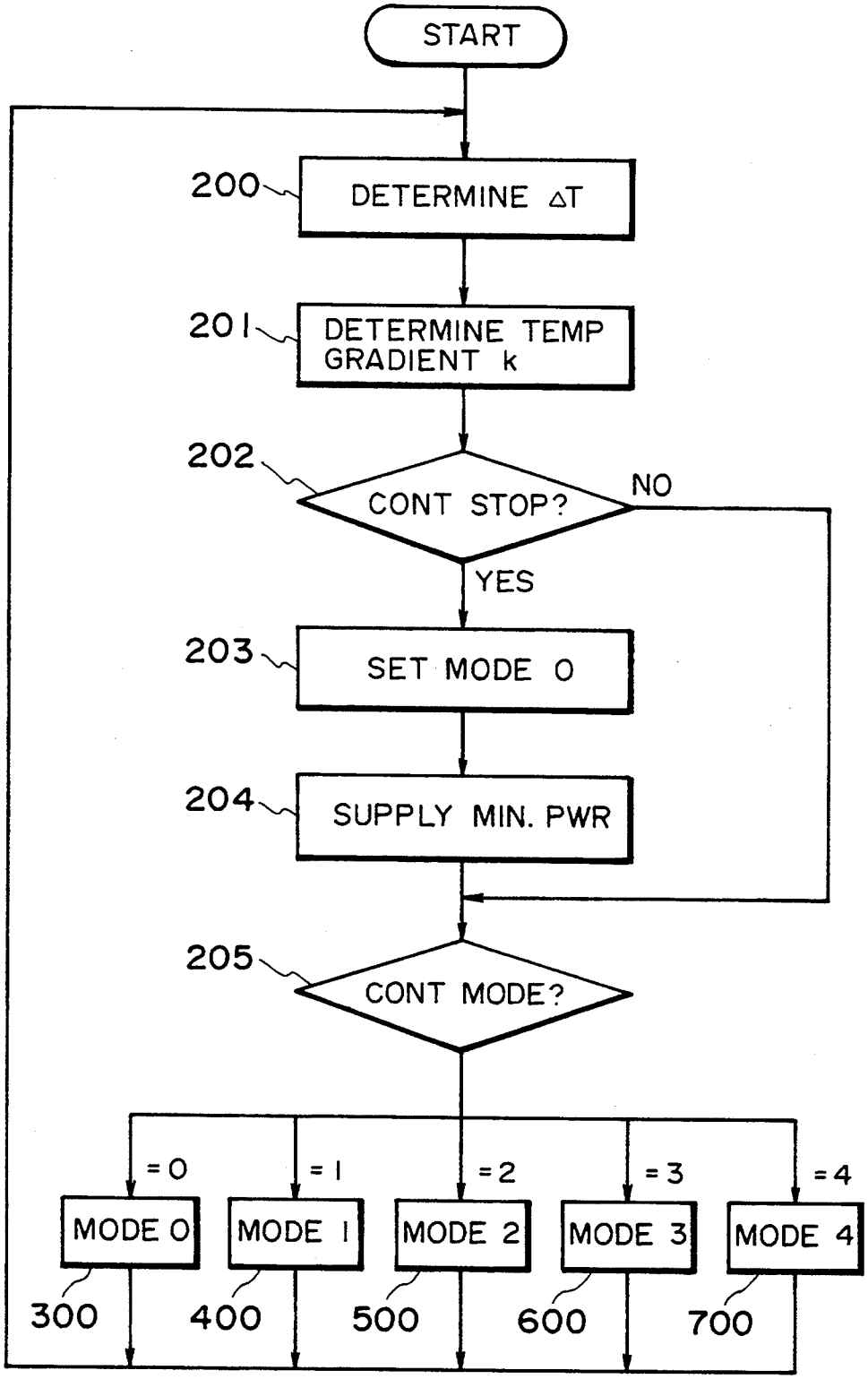
FIG. 21 is a flow chart showing the operation of the preferred embodiment of the present invention.

FIG. 21 shows the flow chart for the operation of the above mentioned control section 21.

There are five control means, modes 0 to 4, for the control section 21.

In the mode 0, the control section 21 remains in the standby state, waiting for the thermostatic control initiation command coming from the main control section of the image forming apparatus in which the heating device in accordance with this embodiment is employed, and the power is not supplied to the halogen heater 5.

In the mode 1, the thermostatic control initiation command is issued, whereby the maximum power is supplied to the halogen heater. This mode is executed for a length of time that is determined by the control section 21 so as to not cause an overshoot.

In the mode 2, the power is not supplied to the heater 25.

The mode 3 is the control mode for the state in which the heating roller surface temperature is higher than or equal to the thermostatic target temperature.

The mode 4 is the control mode for the state in which the heating roller surface temperature is lower than the thermostatic target temperature.

Next, the control operations are described, referring to FIG. 21.

In the figure, five patterns 0 to 4 are available as the control modes for the control section 21.

The mode 0 is the control mode in which the control section 21 waits for the temperature control initiation command coming from the main control section of the not shown recording apparatus, and the power is not supplied to the heater 5.

The mode 1 is the control mode in which the temperature control initiation command from the main control section of the not shown recording apparatus is received to initiate the temperature control, and the maximum power is supplied.

This mode is run for a length of time which is determined so as not to overshoot the thermostatic target temperature.

The mode 2 is the control mode to halt the power supply to the heater 25, which is used to prevent the overshooting, and is executed for a predetermined interval after the completion of the mode 1.

The mode 3 is the control mode for the state in which the temperature detected by the thermistor is higher than the thermostatic target temperature.

The mode 4 is the control mode for the state in which the temperature detected by the thermistor is lower than the thermostatic target temperature.

First, the difference (hereinafter, represented by $\Delta T$) between the target temperature and the temperature detected by the thermistor is obtained (200).

Next, the temperature gradient (hereinafter, represented by k) is obtained (201).

The temperature gradient is obtained based on the difference between the temperature (represented by $T_{n-1}$) corresponding to S1 obtained by the A/D converter 26 in the preceding cycle and the temperature (represented by $T_n$) corresponding to S2 obtained by the A/D converter in the present cycle, and the sampling cycle (represented by $t_{AD}$) of the A/D converter 26, and is compared by the control section 21 using Equation $k=(T_n-T_{n-1})/t_{AD}$.

It is determined whether or not there is a control interrupt command from the main control section of the not shown recording apparatus (202).

If there is none, the control mode is determined (205), and if there is one, the control mode is set to the mode 0 (203), and the power supplied to the heater is set to the minimum setting (duty 0%), which is the heater-off setting, and the next process is carried out.

The control mode is determined (205).

If the control mode is mode 0, MODE-0 is carried out (300); if the control mode is mode 1, MODE-1 is carried out (400); if control mode is mode 2, MODE-2 is carried out (500); if the control mode is mode 3, MODE-3 is carried out (600); and if the control mode is mode 4, MODE-4 is carried out (700).

Figure 22:
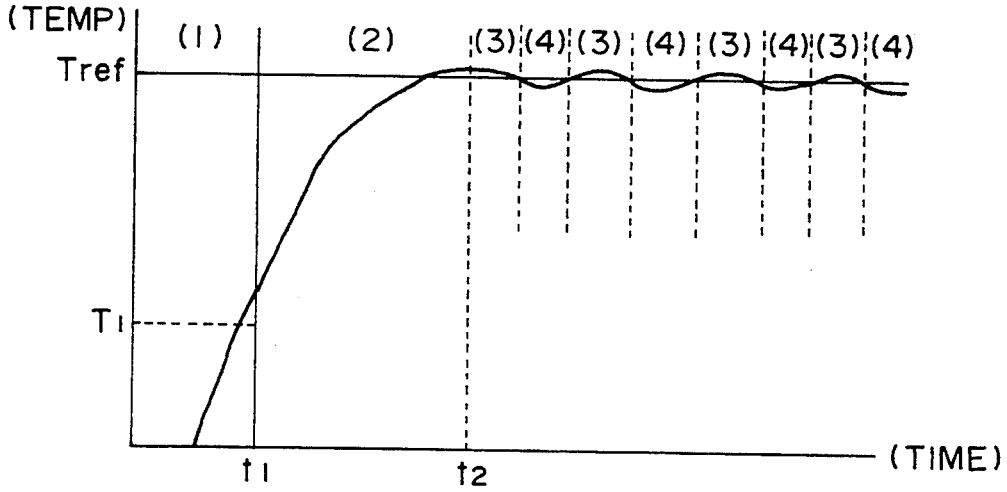
FIG. 22 is a graph showing the relation between the control mode and the temperature fluctuation.
Figure 23:
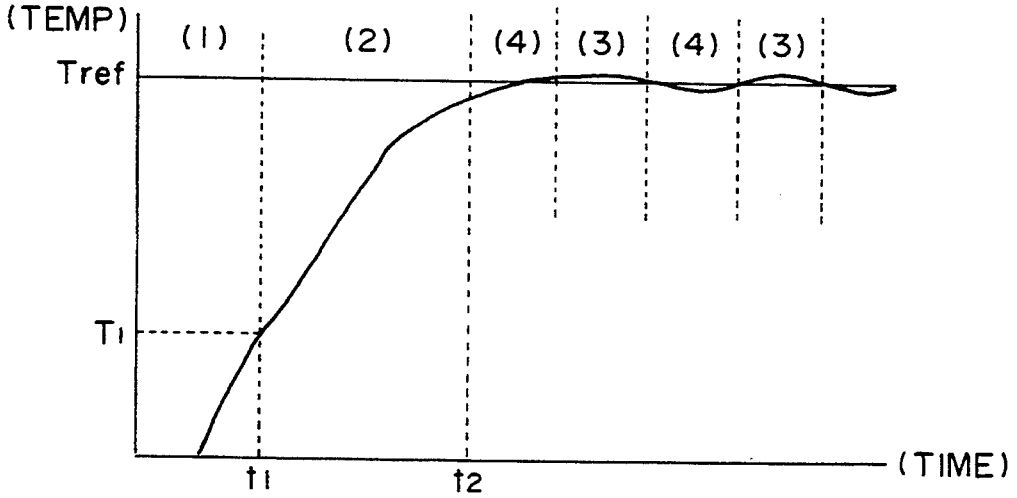
FIG. 23 is a graph showing the relation between the control mode and the temperature fluctuation.

In FIGS. 22 and 23, the temperature fluctuations of the heating roller after the power supply to the heater is started are shown.

Reference numerals (1) to (4) correspond to modes 1 to 4, respectively.

FIG. 22 shows the case in which the thermostatic target temperature is reached at the end of the mode 2, and FIG. 23 shows the case in which it is not reached.

In the example shown in FIG. 22, the control mode 3 is executed following the mode 2, and in the example shown in FIG. 23, the control mode 4 is executed following the mode 2.

$t_1$ is the time when the control temperature $T_1$ is reached after the full power supply to the heater begins, and $t_2$ is a predetermined time when the mode 2 is ended.

Figure 24:
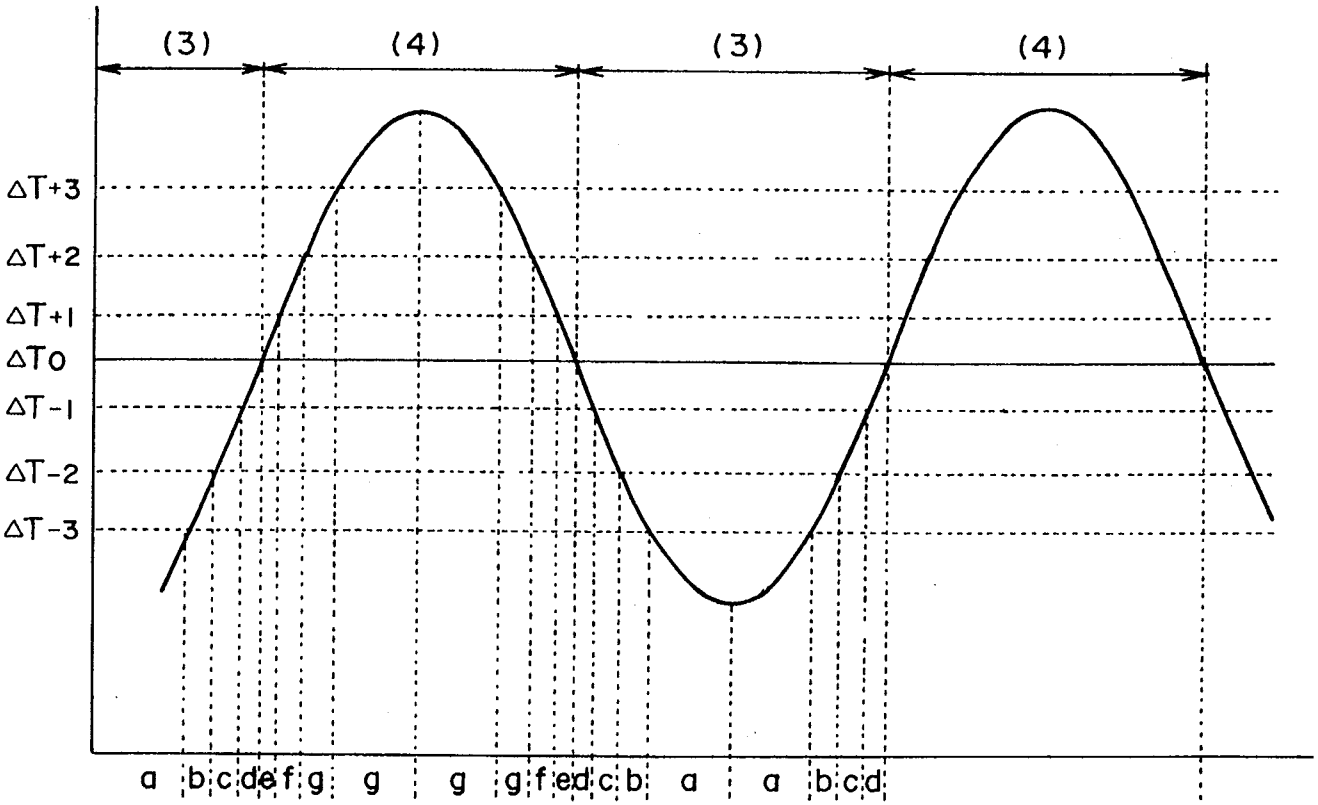
FIG. 24 is a graph showing the relation between the control mode and the temperature fluctuation.

FIG. 24 is a diagram showing the selections of the power supply patterns for the control modes (3) and (4) shown in FIGS. 22 and 23, referring to segments (a), (b), (c), (d), (f) and (g) which correspond to respective temperature deviations $\Delta T_{-3}$to $\Delta T_{-1}$, $\Delta T_0$, and $\Delta T_1$ to $\Delta T_3$.

Corresponding to (a) and (g), $P_8$ and $P_0$ are respectively selected, and corresponding to each of the other segments, one of the power supply patterns shown in FIG. 20 is selected corresponding to the magnitude of the temperature gradient.

Each mode is described in detail.

Figure 25:
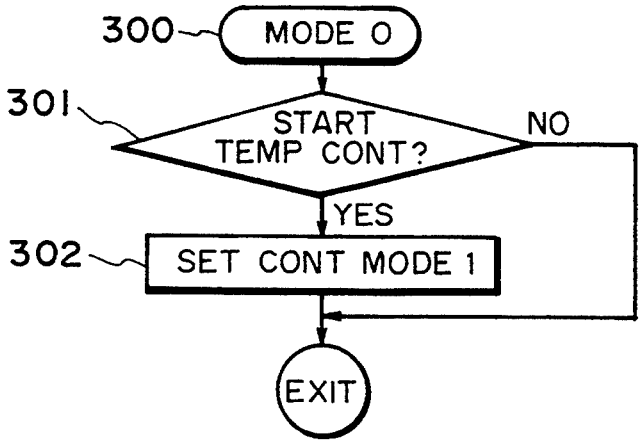
FIG. 25 is a flow chart showing the operation in mode 0.

FIG. 25 is a flow chart describing the operation of the mode 0, wherein it is determined whether or not the temperature control is to be started (301), and if it is to be started, the control mode is set to the mode 1. Otherwise, the mode is ended without further action.

Figure 26:
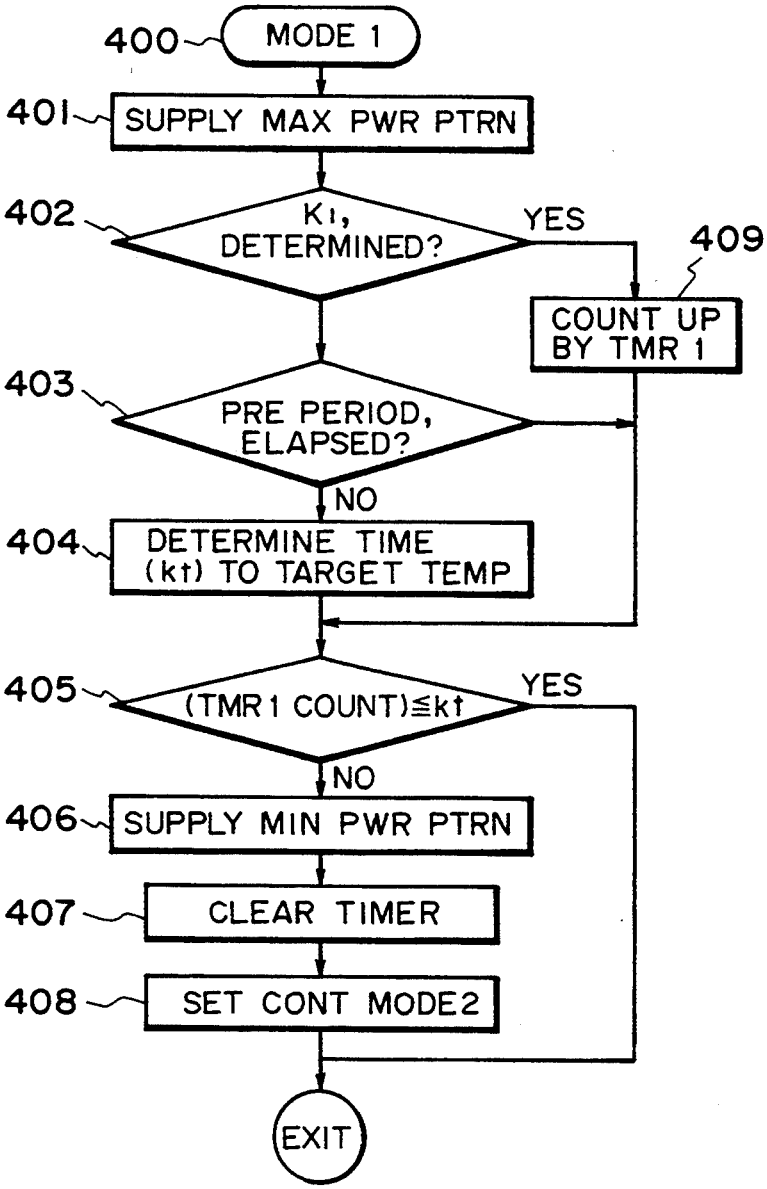
FIG. 26 is a flow chart showing the operation in mode 1.

FIG. 26 is a flow chart describing the operation of the mode 1, wherein the selection signal S5 of the power supply pattern ($P_8$) for supplying the maximum power (duty 100%) to the heater is outputted to the pattern generator 23 (401).

It is determined whether or not the length of time $k_t$ necessary to reach the target temperature has been obtained by proportioning, based on the temperature gradient obtained in advance (402).

If it has not been, it is determined whether or not a predetermined length of time has elapsed since the beginning of the temperature control, and if it has, $k_t$ is obtained and the next step (405) is carried out.

If $k_t$ has been obtained, a timer (TMR 1) is started to count up (409) and the next step (405) is carried out.

Then, it is determined whether or not the count value of TMR 1 has reached $k_t$ (405), and if it has not, the mode is ended, and if it has, the selection signal S5 corresponding to the power supply pattern ($P_0$) for halting the power supply to the heater is outputted to the pattern generator 23 (406). Then, the TMR 1 is cleared to prepare for the next step (407) and the mode 2 is set (408), exiting the step.

Figure 27:
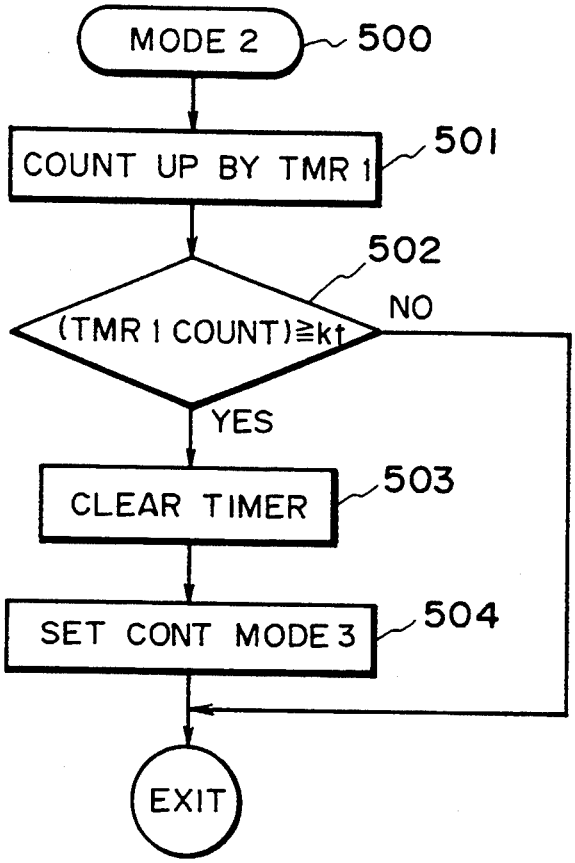
FIG. 27 is a flow chart showing the operation in mode 2.

FIG. 27 is a flow chart describing the operation of the mode 2, wherein the counting by the TMR 1 is started again (501), and it is determined whether or not the count value of TMR 1 has reached $k_t$ (502), and if it has not, the TMR 1 is cleared to prepare for the next step (503), and the control mode 3 is set (504), exiting the step.

Figure 28:
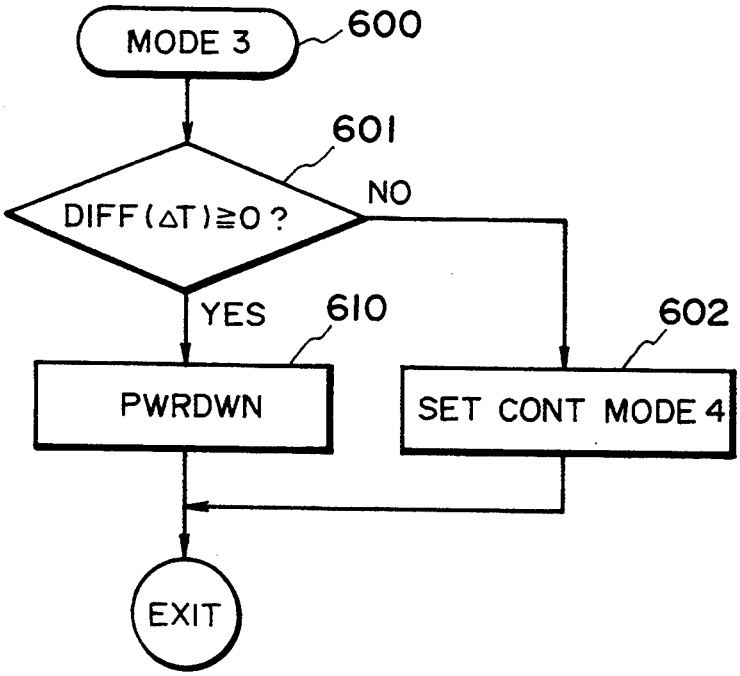
FIG. 28 is a flow chart showing the operation in mode 3.

FIG. 28 is a flow chart describing the operation of the mode 3, wherein it is determined whether the temperature $\Delta T$ is positive, zero, or negative (601); if it is positive or zero, a process for lowering the temperature (hereinafter, represented by PWRDWN)is carried out (610), and if it is negative, the control mode 4 is set (602), exiting the step the step.

Figure 29:
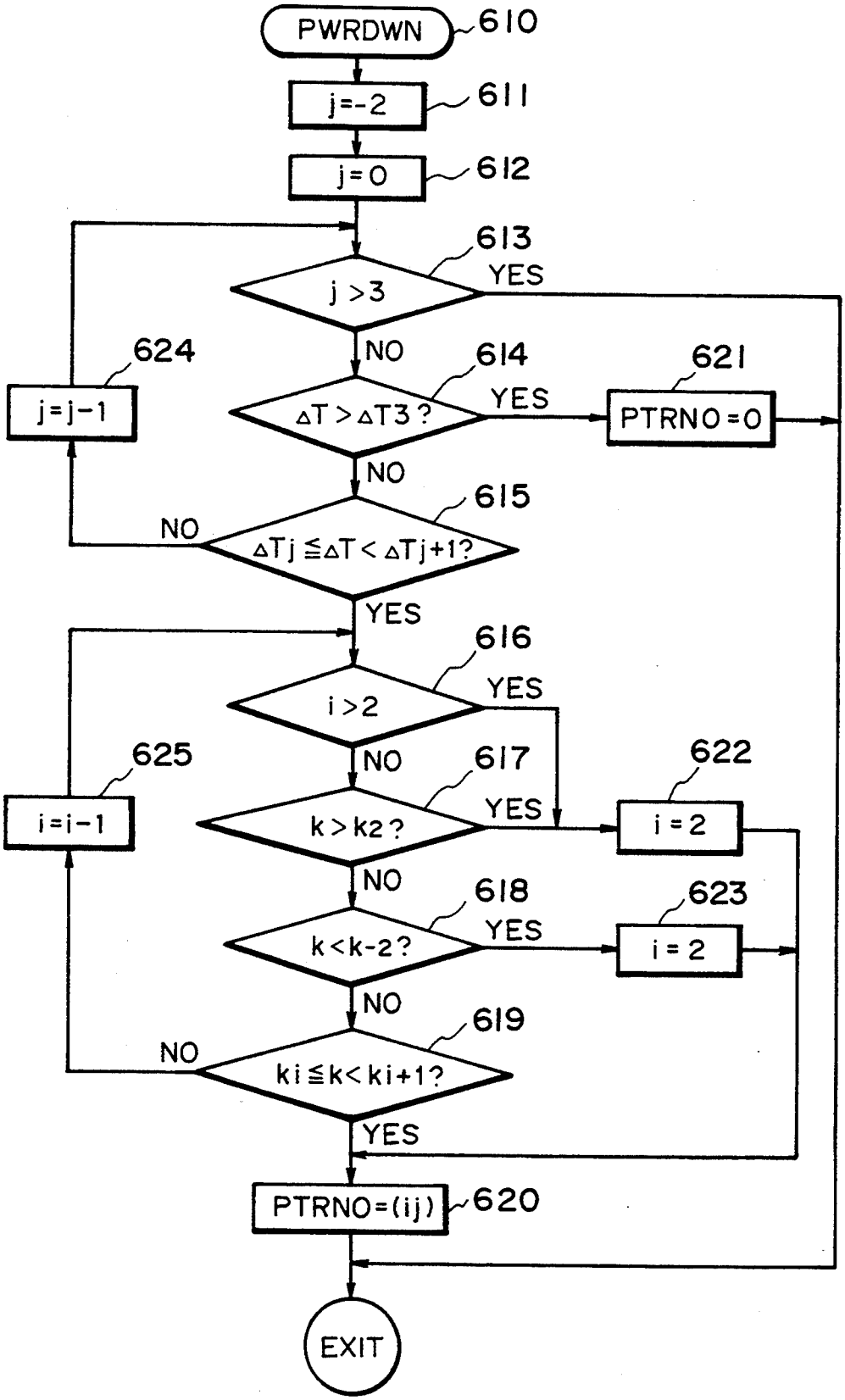
FIG. 29 is a flow chart showing the operation of the preferred embodiment of the present invention.
Figure 30:
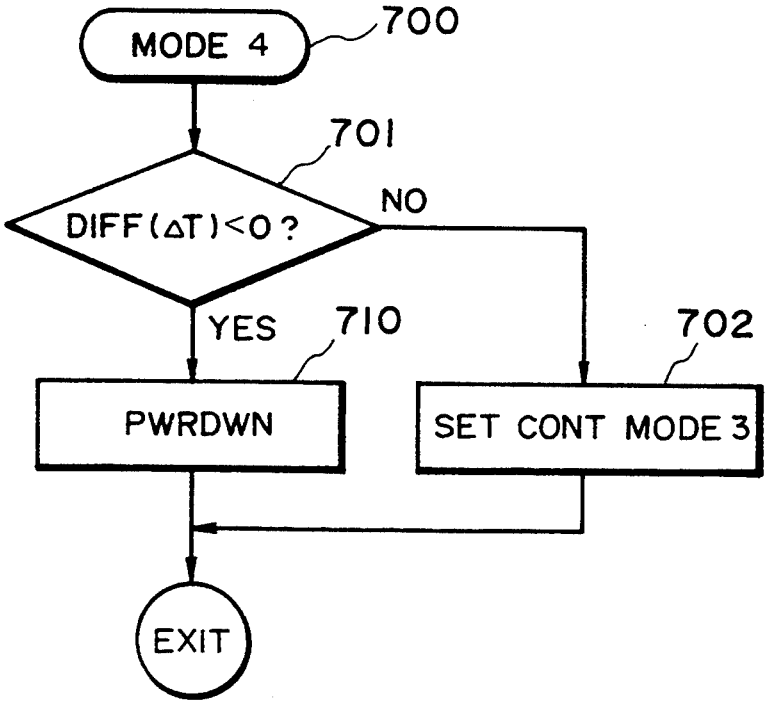
FIG. 30 is a flow chart showing the operation in mode 4.
Figure 31:
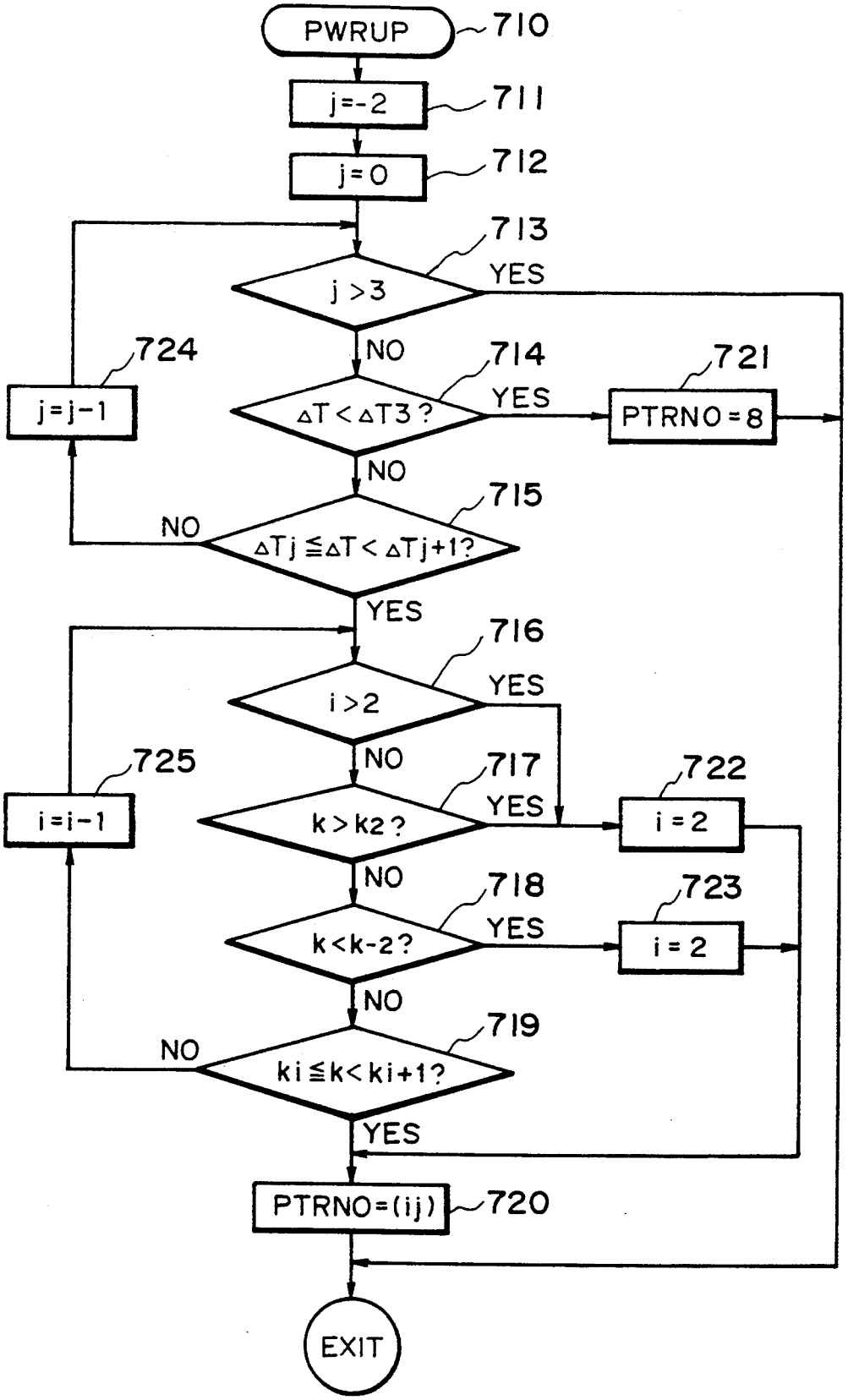
FIG. 31 is a flow chart showing the operation of the preferred embodiment of the present invention.

FIG. 29 is a flow chart describing the operation of the PWRDWN mentioned in the description of FIG. 28. In this step, the power supply pattern is selected from the control table shown in FIG. 20, and a PTRNO, which is the selection signal S5 for selecting one of power supply patterns $P_0$ to $P_8$, is selected to be outputted to pattern generator 23. In the figure, i stands for the subscript for the temperature gradient $k_{-2}$ to $k_0$ to $k_{+2}$ in the column direction in FIG. 20, and j stands for the subscripts for $\Delta T_{-3}$ to $\Delta T_0$ to $\Delta T_{+3}$ in the row direction in FIG. 20.

First, as the initial values, i is substituted by 2 (611) and j is substituted by 0 (612). It is determined whether or not j exceeds the maximum value 3 in column number (613), and if it does, the PWRDWN step ends, and if it does not, the next step (614) is carried out.

Next, it is determined whether or not the temperature deviation $\Delta T$ is larger than the maximum temperature deviation value $\Delta T3$ (614) in the control table. If it is, the PTRNO is set to 0 (621), exiting the step, and if it is not, it is determined whether or not the temperature $\Delta T$ satisfies $\Delta T_j \leqq \Delta T < \Delta T_{j+1}$ (615). If the decision of (615) is yes, the next step (616) is carried out, and if it is no, j is incremented by 1 (624), and the above described step (613) is repeated.

Next, it is determined whether or not i is larger than 2, and if it is, i is substituted by 2 (722), as well as the PTRNO selected corresponding to j obtained as the result of the above mentioned step (715) being outputted as the power supply pattern selection signal S5 to the pattern generator 23 (720), exiting the step, and if it is not, the next step (717) is carried out.

Then, it is determined whether the temperature gradient k is larger than the maximum temperature gradient value k+2 in the control table (717), and if it is, i is substituted by 2 (722), as well as the PTRNO selected corresponding to j obtained as the result of the above mentioned step (715) being outputted as the power supply pattern selection signal S5 to the pattern generator 23 (720), exiting the step, and if it is not, the next step (718) is carried out.

Further, it is determined whether or not the temperature gradient k is larger than the minimum temperature gradient value $k_{-2}$ in the control table (718), and if it is, i is substituted by −2 (723), as well as the PTRNO selected corresponding to j obtained as the result of the above mentioned step (715) being outputted as the power supply pattern signal S5 to the pattern generator 23 (720), exiting the step, and if it is not, the next step (719) is carried out.

Next, it is determined whether or not k satisfies $k_i \leqq k < k_{i+1}$ (719).

If the decision of step (719) is yes, the PTRNO selected corresponding to (i, j) in the control table is outputted as the power supply pattern signal S5 to the pattern generator 23 (720), exiting the step, and if it is not, i is incremented by 1 (725) and the above mentioned step (716) is repeated.

Figures 32, 33:
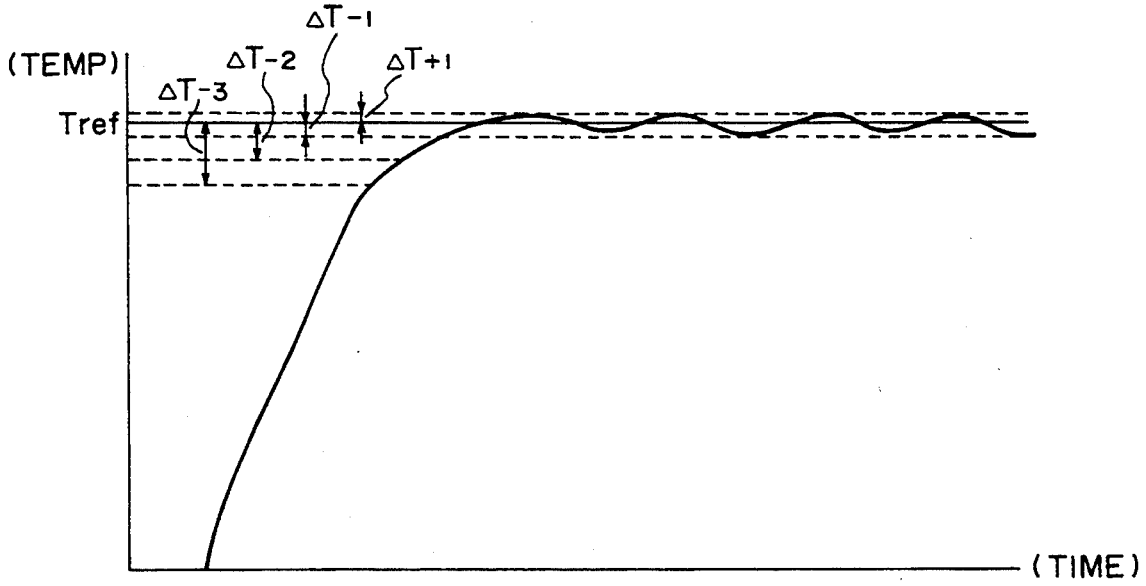
FIG. 32 is a graph showing the temperature fluctuation of the preferred embodiment of the present invention.
FIG. 33 is a control table to be used for the sixth embodiment of the present invention.

In FIG. 32, the thermal properties of the halogen heater 25 employed by this embodiment are shown.

As is show in the figure, the control is set up so that the optimum power supply pattern is outputted based on each segment of the temperature deviation range and each segment of the temperature gradient curve, and therefore, the overshoot of the control target temperature at the beginning of control, as well as the temperature fluctuation thereafter, become smaller.

Sixth Embodiment

In the above mentioned embodiment, a single control table for the temperature gradient and the temperature deviation is stored in the memory, but it is preferable to store more than one control table in the memory, so that selection can also be made for the type of recording material, thickness, and such.

In consideration of a case such that it becomes difficult to control the temperature based on the control table shown in FIG. 20 because the condition of the fixing device changes, two types of control tables may be prepared in the storage means 2, which may be selected depending on the conditions of the fixing device.

Figures 34, 35:
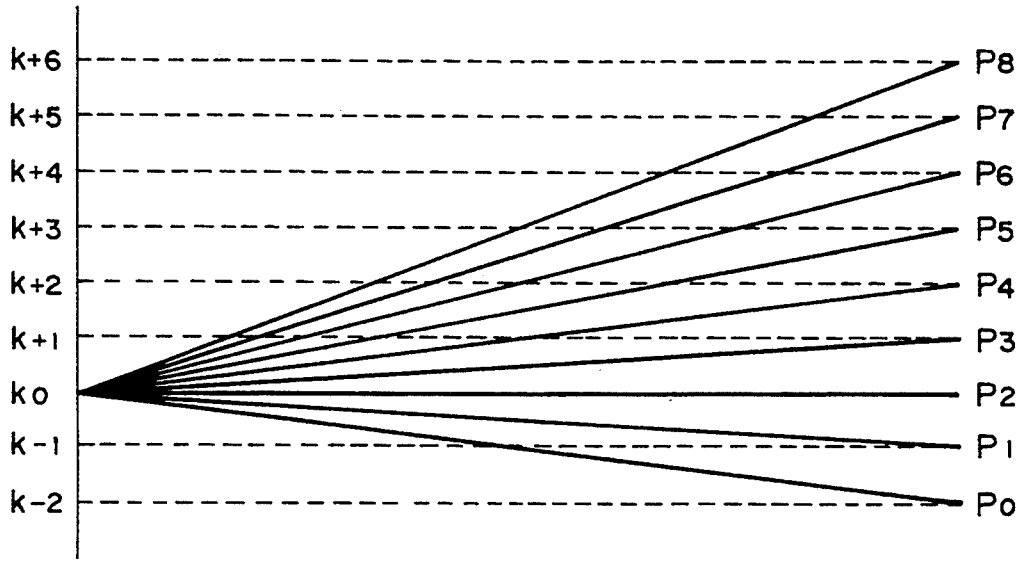
FIG. 34 is a diagram showing the relation between the power supply pattern and the temperature gradient regarding the sixth embodiment of the present invention.
FIG. 35 is a tabulated version of the relation in FIG. 34.

For example, in consideration of a case such that the temperature gradient turns out to be as shown in FIG. 34 because the amount of heat robbed by the recording sheet from the fixing device varies due to the difference in the thickness of the recording sheets, a control table as shown in FIG. 33 is prepared to handle this type of situation. Then, if this control table is selected to carry out the same control operation as that in the first embodiment, it becomes possible to control the temperature, effecting even a smaller amount of temperature function.

FIG. 35 is a tabulated version of FIG. 34, and is self-explanatory.

While the invention has been described with reference to the structures disclosed herein, it is not confined to the details set forth and this application is intended to cover such modifications or changes as may come within the purposes of the improvements or the scope of the following claims.

What is claimed is:

1. An image heating device which comprises:

heater controlled to keep a predetermined temperature;

temperature detecting element to detect a temperature of said heater;

arithmetic means for computing the length of time it takes for the temperature of said heater to reach said predetermined temperature since the beginning of the power supply, based on the temperature gradient of said heater; and control means for halting the power supply to said heater after an elapse of the length of time computed by said arithmetic means, and then, controlling the power supply to said heater, so that the temperature of said heater is maintained at the predetermined temperature.

2. An image heating device in accordance with claim 1, wherein said device further comprises an endless sheet of film which moves together with the recording material carrying an image, and the image is heated through said film by the heat from said heater.

3. An image heating device in accordance with claim 2, wherein said heater remains stationary in use, and said film slides in contact with said heater.

4. An image heating device in accordance with claim 1, wherein the power supply to said heater is halted for a predetermined duration.

5. An image heating device comprising:

a heater;

a temperature detecting element to detect a temperature of said heater;

control means for controlling electric power valve supply to said heater, so that the temperature detected by said temperature detecting element is maintained at a predetermined temperature; and a temperature gradient detecting means for detecting a temperature gradient from a start of electric power supply to said heater until it reaches the predetermined temperature as detected by said temperature detecting element, wherein said control means controls, during a constant temperature control, electric power valve supply to said heater in accordance with an output of said temperature gradient detecting means.

6. An image heating device in accordance with claim 5, further comprising an endless sheet of film which moves together with the recording material carrying an image, wherein the image is heated through said film by the heat from said heater.

7. An image heating device in accordance with claim 6, wherein said heater remains stationary in use and said film slides in contact with said heater.

8. An image heating device in accordance with claim 5, wherein said control means supplies the electric power to said heater during both periods when the temperature of the thermostatically controlled heater is to be raised and when it is to be lowered, in order to control the electric power valve supply during said both periods in accordance with a rising temperature.

9. An image heating device according to claim 5, wherein said temperature gradient is detected while the temperature of said heater is between 100° C. and said predetermined temperature.

10. An image heating device according to claim 5, wherein said control means controls the electric power valve supply on the basis of a temperature deviation for said predetermined temperature and an output of said temperature gradient detecting means.

11. An image heating device according to claim 5, wherein said temperature gradient detecting means detects a time period required for a temperature rise from a predetermined first temperature to a predetermined second temperature.

* * * * *

UNITED STATES PATENT AND TRADEMARK OFFICE

CERTIFICATE OF CORRECTION

PATENT NO. : 5,444,521
DATED : August 22, 1995
INVENTOR(S) : YOHJI TOMOYUKI, ET AL.

It is certified that error appears in the above-indentified patent and that said Letters Patent is hereby corrected as shown below:

Column 5,
line 33, "thermostatic:" should read --thermostatic--.

Column 6,
line 58, "these" should read --there--.

Column 10,
line 64, "$\Delta T_{-3}$to" should read --$\Delta T_{-3}$ to--.

Column 14,
line 1, "valve" should read --value--;
line 11, "valve" should read --value--;
line 27, "valve" should read --value--; and
line 35, "valve" should read --value--.

Signed and Sealed this

Second Day of January, 1996

Bruce Lehman

BRUCE LEHMAN

*Commissioner of Patents and Trademarks*

*Attest:*

*Attesting Officer*